United States Patent [19]

Fish

[11] 4,136,995

[45] Jan. 30, 1979

[54] PORTABLE DAMS

[76] Inventor: Daniel C. E. Fish, 80 Cobham Rd., Ferndown Industrial Estate, Wimborne, Dorset, England

[21] Appl. No.: 870,863

[22] Filed: Jan. 20, 1978

[30] Foreign Application Priority Data

Sep. 28, 1977 [CA] Canada ..... 287727

[51] Int. Cl.[2] ..... E02B 7/00

[52] U.S. Cl. ..... 405/115; 210/162

[58] Field of Search ..... 61/29, 30, 22, 12; 210/162, 154, 155

[56] References Cited

U.S. PATENT DOCUMENTS 716,012 12/1902 Elder ..... 61/29

FOREIGN PATENT DOCUMENTS 843829 7/1952 Fed. Rep. of Germany ..... 61/29

1252595 10/1967 Fed. Rep. of Germany ..... 61/29

*Primary Examiner*—Jacob Shapiro

*Attorney, Agent, or Firm*—Fetherstonhaugh & Co.

[57] ABSTRACT

In a dam comprising a plurality of support posts, said posts being substantially uniformly spaced with respect to one another and having a predetermined pitch spacing, a flexible web having a central body portion and upper and lower marginal edge portions, the improvement wherein said marginal edge portions are uniformly shortened along the length thereof to a length which is less than the unshortened length of the central body portion by a factor of $2/\pi$.

8 Claims, 9 Drawing Figures

PORTABLE DAMS

FIELD OF INVENTION

This invention relates to improvements in temporary dams for waterways and the like. In particular this invention relates to an improved flexible web for use in a temporary dam.

PRIOR ART

Temporary dams have previously been constructed which consist of a plurality of frame members having a web of flexible material draped across one face thereof. In such structures the web of flexible material is of a greater width than the span of the frame members with the result that it is allowed to balloon outwardly between adjacent frame members. In previous constructions considerable difficulty has been experienced in attempting to locate the web so that in use it will extend uniformly across the support frames to form a series of balloon extensions of uniform configuration. The lack of uniformity in the configuration of the web when subjected to water pressure can create an uneven load distribution across the dam structure which can lead to difficulties in maintaining the stability of the strucutre. Lack of loading uniformity can also result in excessive loading of localized areas of the flexible web.

It has been found that the difficulties which have been experienced in the construction of prior temporary dams with respect to load distribution can be overcome by preforming the web of flexible material to a configuration which, when subjected to water pressure, will balloon outwardly at localized areas corresponding to the pitch of the frame members.

It has also been found that optimum load distribution can be achieved when the preformed web is proportioned to ensure that the ballooning segments each have a substantially semi-circular cross-sectional configuration when extended with each of the segments having substantially the same radius of curvature.

According to one aspect of the present invention there is provided a flexible web having a central body portion and upper and lower marginal edge portions, the marginal edge portions being uniformly shortened along their length and a central body portion there being unshortened so that it is free to expand between adjacent frame members of a support frame in a temporary dam construction.

According to a further aspect of the present invention, the width of the web along the uniformly shortened marginal edge is less than the width of the unshortened central body portion by a factor of $2/\pi$. This proportion will permit the width of the web to be divided into a plurality of sections which may balloon outwardly to a semi-circular configuration in use.

Preferably the width of the flexible web is reduced by forming a plurality of pleats extending longitudinally of the web at uniformly spaced intervals across the width thereof corresponding to the pitch of the frame support members to be used and supporting the web. The portions of pleats which extend to the upper and lower marginal edge portions are stitched together to be secured in the pleated configuration while the portions of the pleats which extend longitudinally of the central body portion are free to expand under pressure.

The fact that the web is pleated facilitates the initial installation of the web, in that the unextended width of a portion of the web corresponds to the width over which the web is extended on the frame members. That is to say if the total width of the dam is to be a hundred feet, the pleated width of the portion of the web to be used in forming the dam will also be a hundred feet. If the web were not pleated the width would have to be greater than the width of the dam preferably by a factor of about $\pi/2$ to allow for the required uniform ballooning between support frame members. It will be understood that in practice, the width of the flexible web used in forming of a dam of a hundred feet in width may be considerably greater than a hundred feet, in which case only the required width is secured to the frame members with the remainder being located at one or other end of the frame structure in such a way as to seal the ends of the dam.

In order to ensure accurate location of the pleated segments of the web with respect to the support frames, a plurality of mounting members are preferably located at the upper marginal edge of the web and are secured at uniformly spaced intervals along the width of the web. The pleats which are formed in the web are preferably located centrally between the mounting members so that the pleated central body portions of each section of the web will be located centrally between support members when the web is mounted on the support frame in use.

According to a further aspect of the present invention there is provided a dam comprising a plurality of frame members arranged at spaced intervals across a waterway, each of said members having an upper end and a lower end, and a support rib extending upwardly and rearwardly from said lower end to said upper end, a web of flexible material having a central body portion and upper and lower marginal edge portions, said web being longitudinally pleated at uniformly spaced intervals along the marginal edge portion, the marginal edge portions being secured in the pleated configuration and the pleated central body portion being free to open from the pleated configuration under the influence of water pressure in use, a plurality of mounting members at the upper marginal edge for securing the upper marginal edge to each frame member, said mounting members being located centrally between each pleat whereby each pleat is located centrally between a pair of support ribs to expand therebetween under water pressure to form a plurality of uniform semi-circular water retaining compartments in use.

PREFERRED EMBODIMENT

The invention will be more clearly understood after reference to the following detailed specification read in conjunction with the drawings wherein.

Figure 1:
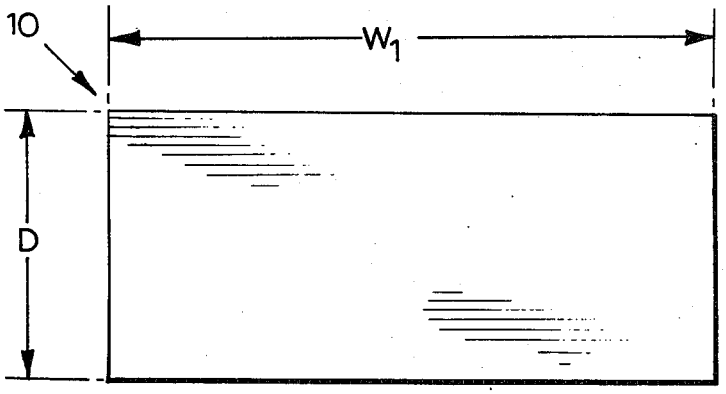
FIG. 1 is a plan view of a web of flexible material prior to pleating.

With reference to FIG. 1 of the drawings, the reference numeral 10 refers generally to a flexible web for use in the construction of a dam according to an embodiment of the present invention. The web is preferably made from reinforced PVC and may be of a construction similar to a nylon reinforced PVC tarpaulin. The web 10 has an unpleated width W1 and a length of depth D.

Figure 2:
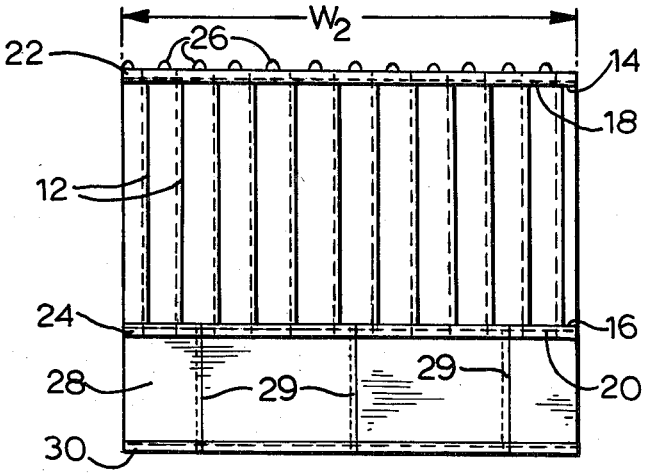
FIG. 2 is a view similar to FIG. 1 showing a pleated web with mounting loops at the upper marginal edge and a skirt at the lower marginal edge.
Figure 4:
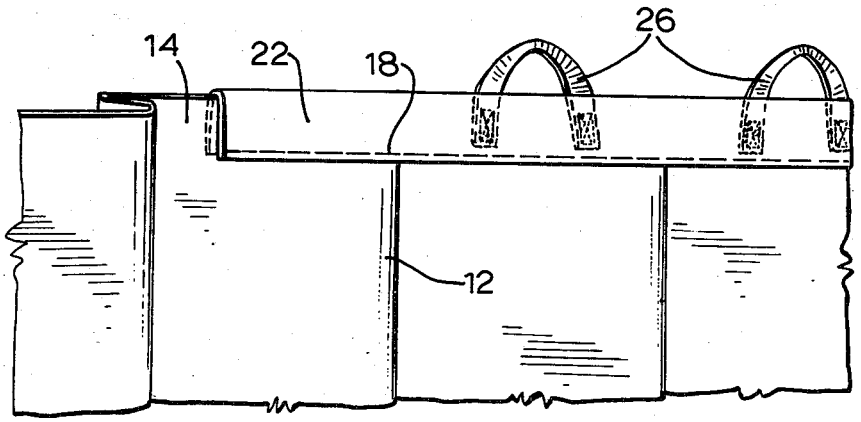
FIG. 4 is an enlarged detailed view of a portion of the upper marginal edge and the binding used to secure the upper marginal edge in the pleated configuration.

As shown in FIGS. 2 and 4 of the drawings, the web is folded upon itself to form a plurality of longitudinally extending pleats 12 which are located at uniformly spaced intervals along the width thereof. The pleats have the effect of reducing the width of the web to a width W2. A U-shaped binding 22 is secured along the upper marginal edge portion and a feather banding 24 is secured along the lower marginal edge portions. The stitching at line 18 also serves to secure pleat 20 at upper marginal edge portion 14. The lower marginal edge portion 16 is stitched along a stitch line 20 to permanently secure the pleats at the lower marginal edge portion. The upper binding 22 has a plurality of loops 26 secured thereto at uniformly spaced intervals along the length. The binding 22 is secured with respect to the upper marginal edge so that a mounting loop 26 will be located centrally between each adjacent pair of longitudinal plates. A sealing sheet in the form of a skirt 28 is longitudinally pleated at pleat lines 29 and is secured in the pleated configuration to the lower marginal edge and is formed with a sleeve hem 30 at the lower edge thereof through which a weight member such as a chain 31 (FIG. 8) may be threaded to weight the skirt so that it will sink in use.

Figure 5:
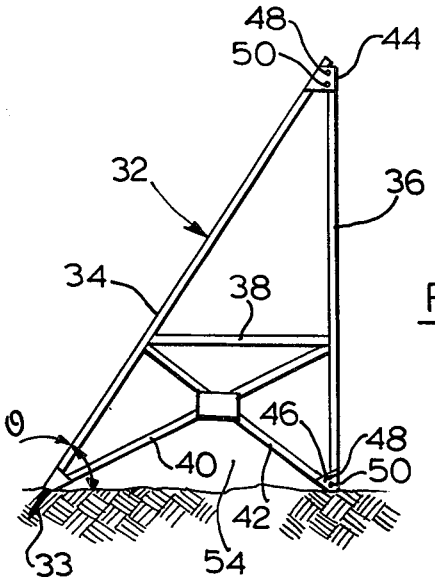
FIG. 5 is a side view of a frame member constructed in accordance with one aspect of the present invention.
Figure 7:
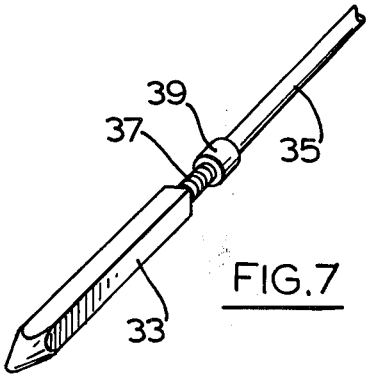
FIG. 7 is a pictorial view of an anchor pick and a mounting rod for use in locating the anchor pick.

With reference to FIG. 5 of the drawings, the reference numeral 32 refers generally to a support frame according to one embodiment of the present invention. The frame consists of a support rib 34, a back strut 36, a tie 38, a tie 40 and a strut 42. The support rib 34 is preferably made from a hollow rectangular shaped section through which an anchoring pick 33 may be extended to be embedded in the bed of the waterway in use if required. Similarly, the back strut 36 may be hollow to receive an anchoring pick. Brace plates 44 and 46 are located at the upper and lower ends of the back strut 36 respectively. The brace plates 44 and 46 have upper and lower passages 48 and 50 extending therethrough.

The angle of inclination $\theta$ of the support rib 34 with respect to the bed of the waterway may vary depending upon the co-efficient of friction of the material forming the bed of the waterway. Generally, however, the angle $\theta$ will be no more than 42°. The back strut 36 should have an angle of no more than 90° with respect to the bed of the waterway on which the frame is resting. The space 54 formed below the tie 40 and strut 42 provides clearance to accommodate irregularities in the bed of the waterway. The tie 40 and strut 42 serve to provide sufficient rigidity to the frame structure.

The frames 32 are flat in front view so that they may be stacked one upon the other in a side-by-side relationship for shipping in a compact load. A typical frame may have a back strut 8 feet in length with a rib 12 feet in length. The rib and back strut may be constructed from hollow rectangular seal sections measuring 2 inches by 3 inches and having a wall thickness of 0.188 inches. The strut and tie may be hollow 2 × 2 tubular members having a wall thickness of 0.125 inches. The components of the frame are preferably welded to one another in the reguired configuration to form a rigid frame.

Figure 6:
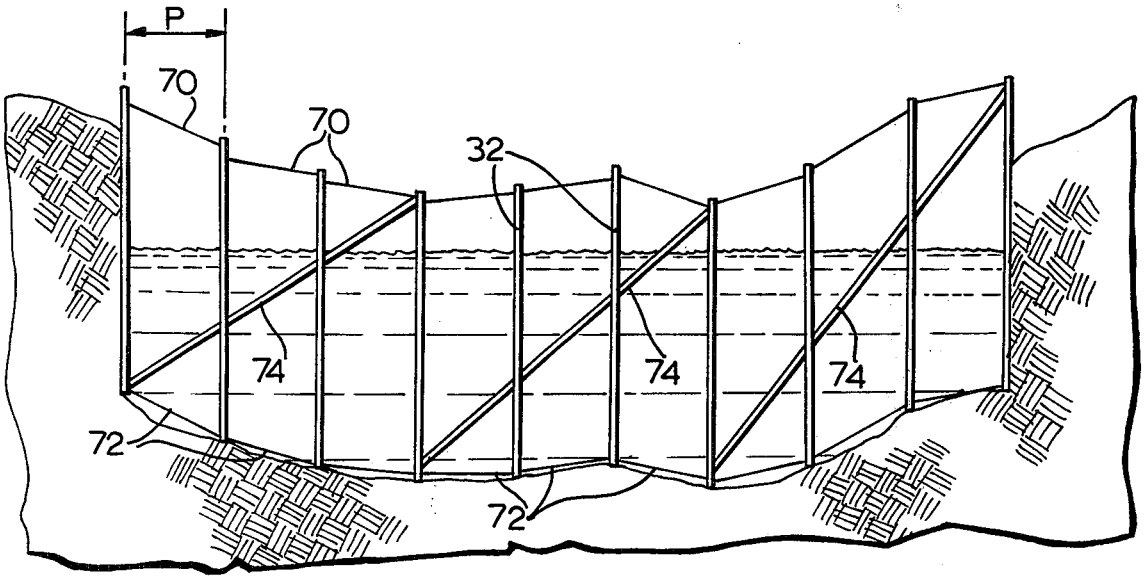
FIG. 6 is a front view of a plurality of frame members mounted in a waterway.

FIG. 6 of the drawings illustrates the manner in which a plurality of frame members 32 are located in a waterway at uniformly spaced intervals P across the width thereof. The frame members 32 are connected by links 70 and 72 which extend between the anchor plates 44 and 46 respectively. The provisions of two passages 48 and 50 in each anchor plate permits the links 70 and 72 to be connected through either passage. The links 70 and 72 serve to retain the frame members 32 in the spaced relationship. A plurality of angularly inclined transversely extending brace members 74 serve to secure a group of frames 32 with respect to one another against lateral movement.

Figure 8:
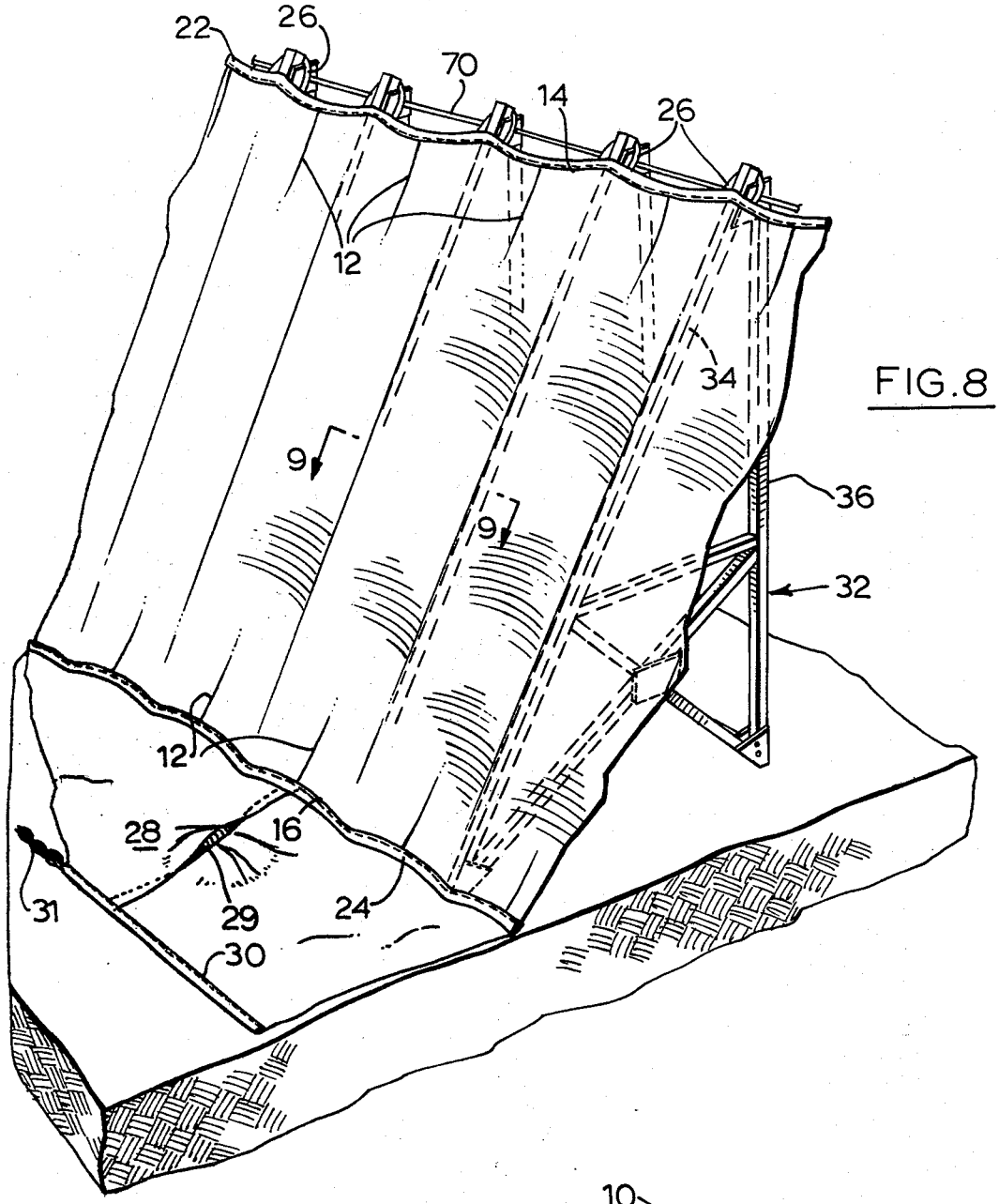
FIG. 8 is a pictorial view of a portion of a web when expanded under water pressure.

The frame members 32 may be anchored to the bed of the waterway by driving picks 33 through the hollow interior of the tubular members such as the support rib 34. A pick 33 is illustrated in FIG. 8 of the drawings. The pick is of a cross-section coresponding to the cross-section of the passage through which it is driven so that it may be locked against rotation with the frame member. The pick 33 has a threaded stem 37 at one end thereof and is pointed at the other end. A shaft 35 is provided for driving the pick longitudinally through the frame member which it is to secure. The shaft 35 has a nut 39 at the lower end thereof adapted to threadably engage the stem 37 to releasably secure the pick with respect to the shaft 35 during the mounting operation. The shaft 35 has a sufficient length to extend through the frame and is disconnected after the pick is driven home by releasing the nut 39 from the stem 37.

Figure 9:
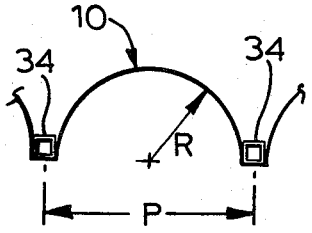
FIG. 9 is a sectional view of the web taken along the line 9–9 of FIG. 8.

FIGS. 8 and 9 of the drawings show the configuration of the flexible web when in use and subjected to water pressure. As shown in FIG. 8, the flexible web 10 is extended over angularly inclined ribs 34 and mounting loops 26 are looped over the upper end of each frame member 32. As previously indicated the loops 26 serve to center a pleat 12 between each adjacent pair of ribs 34. The skirt 28 extends outwardly from the lower marginal edge 16 along the bed of the waterway. When a pressure differential is established between the outer face of the flexible web which faces away from the frame member 32 and the inner face which rests on the frame members 32 the pleats 12 will open in the unrestricted portions which extend away from the marginal edge portions 12 and 16 so that the web will balloon out to the semi-circular configuration illustrated in FIG. 9 of the drawings. This provides an even distribution of the load across the web and serves to maintain the stability of the loaded dam.

The pleats 29 of the skirt 28 will open out to accommodate irregularities in the bed of the waterway. This is important as it prevents pulling-in at the edges of the skirt. Instead of bridging hollows or stretching over ridges the skirt will follow the contour of the bottom and seal the lower edge of the web 10.

It will be apparent that the proportions of the dam including the hitch between adjacent frame members may vary depending upon the depth of water to be dammed and the overall length of the dam, certain proportions are maintained substantially constant. In particular, if the pitch P is known for a particular dam configuration the unpleated width and pleated width may be determined by the formula:

$$W_1 = W_2 \frac{\pi}{2} = (n - 1) P \frac{\pi}{2}$$

wherein:

p is the pitch of the support $W_1$ is the unshortened width of the web $W_2$ is the shortened length of the web n is the number of supports assuming one support at each end of the span.

From the foregoing it will be apparent that regardless of the pitch the relationship between the shortened width and the unshortened width is governed by the constant $\pi/2$ to provide a semi-circular arc of curvature in the expanded web between each support.

It will also be apparent that the present invention provides a simple and effective method of ensuring an even load distribution across a flexible web of a temporary dam. The pleats which are formed in the web and are secured at the upper and lower marginal edges thereof serve to provide an acquired arc of curvature in the loaded membrane as it extends between adjacent supports. The mounting loops which are secured to the marginal edge midway between each pleat serves to positively locate the pleats centrally of each adjacent support frame.

Figure 3:
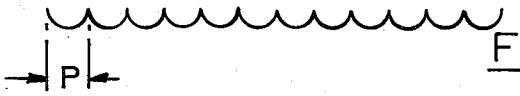
FIG. 3 is a diagramatic representation of the manner in which the central body portion of the web will expand in use.

To use the dam in a waterway which is full of water the frame members are secured in position as shown in FIG. 6 of the drawings with the ribs 34 directed towards the body of water to be dammed. The flexible web is draped across the waterway and above the ribs 34 and the mounting loops 26 of the upper marginal edge are looped over the upper end of a frame member 32. A weight such as a chain 31 is threaded through the sleeve 30 at the outer end of the skirt 28 so that the skirt sinks to the bed of the waterway. When the skirt 30 is resting on the bed of the waterway pumping is commenced to remove water from the downstream side of the dam thereby establishing a pressure differential between the two surfaces of the flexible web. As a result of the pressure differential between the outer and inner faces of the flexible web the water pressure will rapidly open the pleated central portion of the body until the web assumes the cross sectional configuration shown in FIGS. 3 and 9 of the drawings.

From the foregoing it will be apparent that the present invention provides simple and inexpensive flexible web for use in a temporary dam such as a portable dam.

What I claim as my invention is:

1. In a dam comprising a plurality of support posts, said posts being substantially uniformly spaced with respect to one another and having a predetermined pitch spacing, a flexible web having a central body portion and upper and lower marginal edge portions, the improv wherein said marginal edge portions ar uniformly shortened along the length thereof to a length which is less than the unshortened length of the central body portion by a factor of $2/\pi$.

2. In a dam comprising a plurality of support posts, said support posts being substantially uniformly spaced with respect to one another and having a predetermined pitch spacing, a web of flexible material having a central body portion and upper and lower marginal edge portions, the marginal edge portions being uniformly shortened along the length thereof, the length of the marginal edge portions and central body portion being determined by the formula $L_1 = L_2 \times \pi/2 = nP\pi/2$ wherein $L_1$ = unshortened length of web, $L_2$ = shortened length of marginal edge portion and P = pitch spacing of support posts.

3. A temporary dam wall comprising a web of flexible material having a central body portion and upper and lower marginal edge portions, said web being pleated at uniformly spaced intervals along the marginal edges thereof with pleats which extend between the marginal edge portions, the marginal edge portions being secured in the pleated configuration and the pleats of the central body portion being free to open under the influence of water pressure to form a series of uniform semi-circular load distributing panels in use.

4. A dam wall as claimed in claim 3 in which said marginal edge portions are bound to secure the pleats.

5. A dam wall as claimed in claim 4 including sealing sheet means secured to the lower marginal edge and projecting downwardly therefrom.

6. A dam wall as claimed in claim 5 wherein said sealing sheet has a lower edge spaced outwardly from the lower marginal edge of the flexible web and weight means at the lower edge of said sealing sheet for weighting said sealing sheet so that it will sink.

7. A dam comprising:

(a) a plurality of frame members arranged at spaced intervals across a waterway, each of said members having an upper end and a lower end, a support rib extending upwardly and rearwardly from said lower end to said upper end, (b) a web of flexible material having a central body portion and upper and lower marginal edge portions, said web being longitudinally pleated at uniformly spaced intervals along the marginal edge portion, the marginal edge portions being secured in the pleated configuration and the pleated control body portion being free to open under the influence of water pressure in use.

(c) a plurality of mounting members at said upper marginal edge for securing said upper marginal edge to each frame member, one said mounting member being located centrally between each pleat whereby each pleat is located centrally between a pair of support ribs to expand therebetween under water pressure in use to form a plurality of uniform semicircular water retaining compartments.

8. A dam as claimed in claim 7 wherein said web has an unpleated skirt portion extending outwardly from the lower marginal edge thereof.

* * * * *